US005246327A

United States Patent [19]

Alston et al.

[11] Patent Number: 5,246,327

[45] Date of Patent: Sep. 21, 1993

[54] APPARATUS AND METHOD FOR PRECISELY DISPENSING SOLID MATERIALS

[75] Inventors: Wilton D. Alston; Mark T. Bruzzi; Peter C. Sherer, all of Rochester, N.Y.

[73] Assignee: Eastman Kodak Company

[21] Appl. No.: 729,114

[22] Filed: Jul. 12, 1991

[51] Int. Cl.[5] ..... B65G 65/00

[52] U.S. Cl. ..... 414/417; 222/386.5; 414/420; 414/786

[58] Field of Search ..... 414/417, 786, 419–421; 222/386.5, 389, 105

[56] References Cited

U.S. PATENT DOCUMENTS

| | | | |
|---|---|---|---|
| 1,953,042 | 3/1934 | Cody | 414/419 |
| 2,738,805 | 3/1956 | David | 414/421 |
| 3,294,265 | 12/1966 | Roch et al. | 414/417 |
| 3,306,479 | 2/1967 | Hopfeld | 414/421 X |
| 4,095,707 | 6/1978 | Kowtko | 414/421 X |
| 4,735,543 | 4/1988 | St. Lawrence | 414/421 |
| 4,797,050 | 1/1989 | Habicht | 414/420 |
| 4,946,071 | 8/1990 | Poulton | 222/105 |
| 4,986,717 | 1/1991 | Cummins et al. | 414/421 X |

FOREIGN PATENT DOCUMENTS

| | | | |
|---|---|---|---|
| 40146 | 3/1980 | Japan | 414/421 |
| 1222613 | 4/1986 | U.S.S.R. | 414/421 |

*Primary Examiner*—David A. Bucci
*Attorney, Agent, or Firm*—Foley & Lardner

[57] ABSTRACT

A method and apparatus for accurately discharging the entire contents of a container is disclosed. A rigid container has an open upper end and at least one hole in the bottom of the container. The container has a flexible liner with a neck portion which is folded back around the upper end of the container to form a cuff. The cuff is sealed against the sides of the container and the container is inverted. A gas is injected through the hole or holes in the bottom of the container into the space between the flexible liner and the container. This everts the liner and insures that all of the contents of the container are dispensed.

22 Claims, 3 Drawing Sheets

APPARATUS AND METHOD FOR PRECISELY DISPENSING SOLID MATERIALS

DESCRIPTION

1. Technical Field

This invention relates to materials handling equipment and more particularly to equipment for accurately discharging the entire contents of a container.

2. Background Art

Materials for use in manufacturing processes, particularly for use in manufacturing processes comprising the mixing or reacting of the materials, are typically packaged in containers. Various specialized mechanisms have been proposed for handling these containers.

For example, U.S. Pat. No. 4,095,707 relates to a transfer mechanism for dumping the contents of a shipping drum containing a powdery substance into a mixing vessel without the release of any dust or "smoke." The mixing vessel is turned upside down over the open shipping drum. A seal is formed between the top of the shipping drum and the mixing vessel, and the combination is rotated 180° so that the mixing vessel returns to its operative position, and the contents of the shipping drum are transferred to the mixing vessel. The shipping drum may have a plastic liner.

U.S Pat. No. 4,946,071 relates to equipment for discharging particular solid materials from intermediate bulk containers comprising an outer, reusable bag and an inner liner having a spout portion. The spout is clamped over the mouth of a discharge duct.

U.S Pat. No. 1,953,042 relates to a bag emptying device designed to prevent foreign objects on the outside of the bag from being introduced along with the contents of the bag. The bag is placed in a cylindrical casing, and the top of the bag is fastened to the top of the casing. The bag can then be dumped without having material clinging to the outside of the bag being emptied into a bin or other container.

Thus, various equipment for the handling of containers has been proposed. A special problem arises, however, during manufacturing processes that require accurate amounts of various materials to be mixed or reacted. These materials are generally packaged in a specified amount in a container. It is essential that all of the material in the container be transferred to the mixing vessel in order to insure that the end product meets specifications. With the advent of automatic handling equipment in manufacturing lines, it is especially imperative to provide equipment which reproducibly delivers the entire contents of a container, without the necessity for human intervention or monitoring.

Because shipping containers vary in weight, and since the accuracy of delivery must be quite high in many manufacturing processes, a system based on tare weight is inadequate. Similarly, systems which detect, visually or otherwise, some property of the material in the container, and thereby determine whether any of the material remains in the container, are unworkable where the same apparatus is used to empty containers of different materials. In addition, systems based on tare weight or other detection systems merely highlight the existence of a problem. A more preferable solution to the problem is a system which simply and reproducibly delivers all of the contents of a container to a mixing vessel.

SUMMARY OF THE INVENTION

The present invention solves the problem of incomplete delivery of the contents of a container by materials handling equipment.

According to the invention, a materials handling system is provided that comprises a rigid container having an open upper end and at least one perforate region which allows the passage of a gas; a flexible liner in the container, an upper portion of the flexible liner being adapted for sealing against a side of the container to create a closed space between the container and the liner into which a gas can be injected through the perforate region; means for grasping and inverting the container; and means for injecting a gas through the perforate region into the space between the flexible liner and the container to evert the flexible liner.

The invention also provides a method for precisely dispensing the contents of a container, comprising the steps of providing a rigid container having an open upper end and at least one perforate region which allows the passage of a gas, the container having a flexible liner adapted to be sealed against a side of the container; sealing the liner against a side of the container to create a closed space between the container and the liner into which a gas can be injected through the perforate region; grasping and inverting the container; and injecting a gas through the perforate region in the container into the space between the flexible liner and the container to evert the flexible liner.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
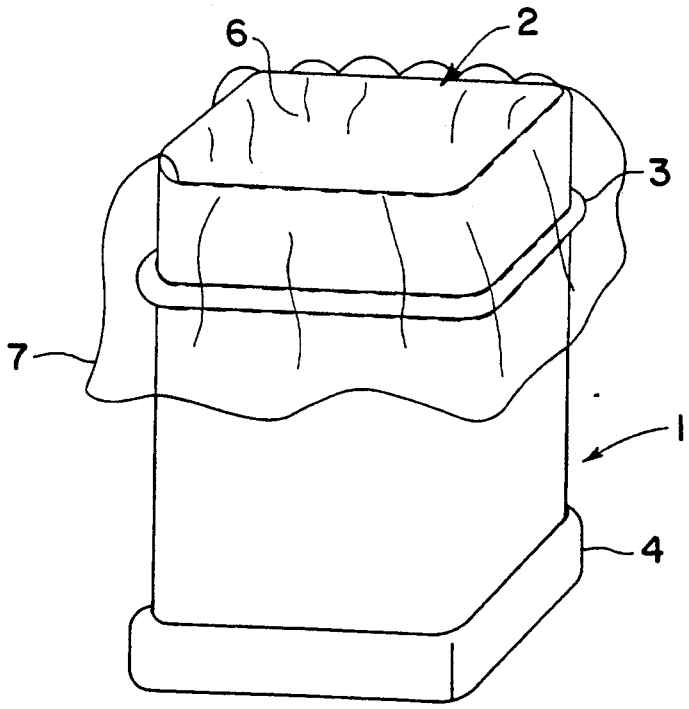
FIG. 1 is a perspective view of the container with the liner.

A preferred embodiment of a container according to the present invention is shown in FIG. 1. Container 1 has open upper end 2, which is adapted to receive a lid (not shown). Container 1 is specially adapted for use in an automated manufacturing line. For this purpose, it is provided with portions which interact with equipment in the manufacturing line, so that it can be securely transported to a dumping station and dumped.

Figure 2:
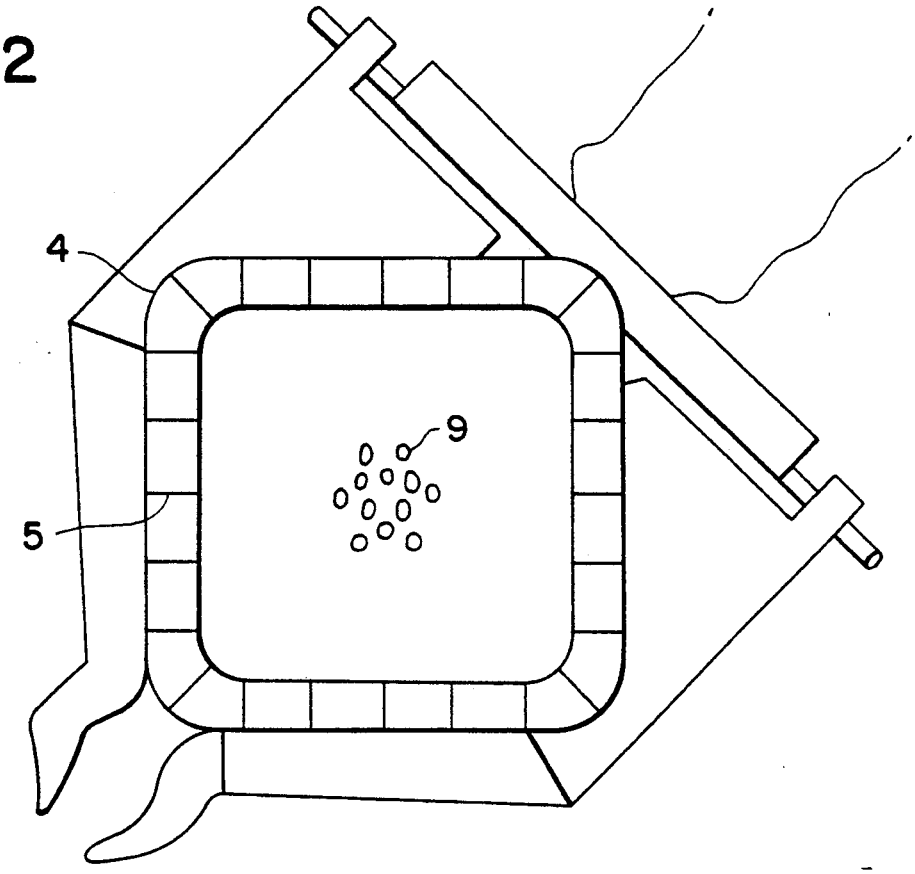
FIG. 2 is a view of the bottom of the container in the robot gripping mechanism.
Figure 3:
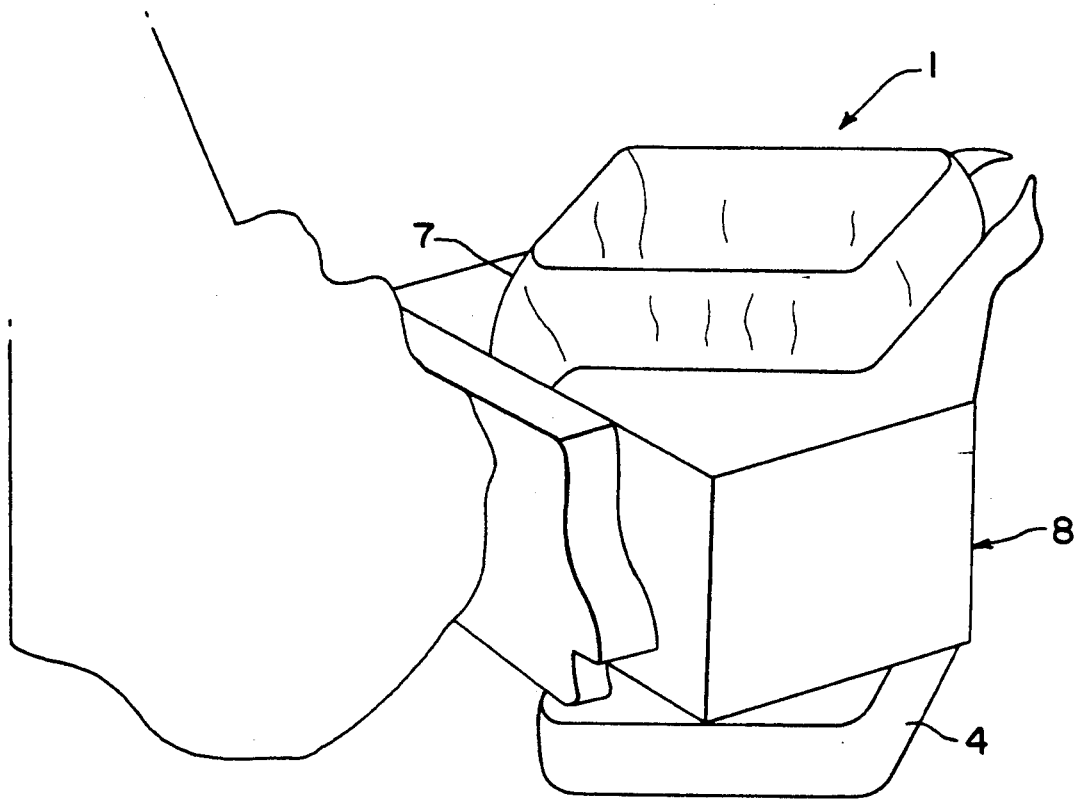
FIG. 3 is a perspective view of the container gripped by the robot gripping mechanism.

The preferred embodiment of container 1 shown in FIG. 1 has interactive portions at both the top and bottom. Near upper end 2 is lip 3, which extends outwardly from the outer surface of container 1. Lip 3 cooperates with robot gripping mechanism 8, as shown in FIG. 3, to serve as a stop against which robot gripping mechanism 8 rests, and to facilitate sealing of liner 6 to container 1. Lip 3 is shown as continuous. This is a preferred embodiment which improves sealing of liner 6 by robot gripping mechanism 8. Lip 3 can also be discontinuous. Inverted U-shaped extensions 4 at the bottom of container 1 interact with an automated handling system (not shown) which moves container 1 between stations in the manufacturing line. Viewed from the bottom (FIG. 2), extension 4 appears as an outer wall. Supporting ribs 5 extend between the wall of container 1 and extension 4.

Container 1 contains flexible liner 6 in which a solid material, either free-flowing or gelatinous, is contained. In a preferred embodiment, liner 6 is not permanently attached to container 1, allowing it to be easily disposed of after container 1 has been emptied of its contents. The material of liner 6 depends on the solid material to be contained; it is required that the liner material not react with the solid material it contains. In addition, if the solid material is sensitive to light, liner 6 should not transmit light of the wavelength to which the material is sensitive. In this case, it is expedient to use a liner made of multiple layers, preferably three. This ensures that light does not enter through pinholes in liner 6.

In a preferred embodiment, liner 6 does not permit the passage of a gas. It is, however, possible for there to be some passage of gas around the edge of or through liner 6, so long as sufficient gas pressure is used to evert liner 6.

Preferably liner 6 is made of a plastic material, for example, polyethylene, in a thickness between about 2.5 mil and 5 mil. Commercially-available conventional equipment designed to insert liners into containers is used to place liner 6 into container 1. While thicker liners can be used in principle, they generally cannot be successfully inserted with the conventional equipment. It is preferred to use a liner that is about 2.5 mil thick.

According to the invention, liner 6 is sealed against a side of container 1 when the contents of the container are to be dumped. In a preferred embodiment, liner 6 has cuff 7 which can be turned back over open upper end 2 of container 1. Cuff 7 can be conveniently sealed against the outside of the container by gripping the container over cuff 7 with robot gripping mechanism 8 when the contents of container 1 are to be dumped. Where container 1 is to be refilled with the same material, liner 6 does not have to be changed after the contents of container 1 are dispensed. In this case, liner 6 can be permanently sealed to a side of container 1. Liner 6 can be permanently sealed to the inside of container 1.

Liner 6 does not necessarily have to be completely sealed against container 1. For example, robot gripping mechanism 8 may only grasp container 1 at certain points. In this case, greater gas pressure is required to evert liner 6. A complete sealing of liner 6 to container 1 is the most efficient embodiment from the standpoint of the gas pressure required to evert liner 6.

Container 1 can be made of various materials, provided they are rigid. For example, it can be made of metal or plastic, especially polyethylene. It can expediently be made by injection molding a plastic material in the desired shape. The container shown in the figures is of a generally square shape, but could be various other shapes, for example, round. There is at least one perforate region in container 1 that allows a gas to be forced into the space between container 1 and the liner 6 or that allows the gas to be withdrawn from this same space. The perforate region can comprise a hole or preferably a plurality of holes 9, as shown in FIG. 2. It is particularly preferred that the perforate region be in or near the bottom of container 1.

Container 1 can be conveyed by an automated handling system to a dumping station where its contents are to be dispensed. There it is grasped by robot gripping mechanism 8, which may be of various types which are known in the art. When a container adapted to interact with an automated handling system, such as the one shown, is used, robot gripping mechanism 8 must be able to lift the container to free it from the automated handling system (z-direction movement), it must be able to move the container over the mixing or reactor vessel (x-direction movement), and it must also be capable of rotating about its center axis in order to dump the contents of the container (pitch and yaw). Robot gripping mechanism 8 may also be capable of other movements, depending on the particular situation.

Robot gripping mechanism 8 is adapted to the shape of container 1 in order securely to grasp it near the top, just below lip 3. In the preferred embodiment, robot gripping mechanism 8 securely holds cuff 7 in place and seals it against the outside of container 1 in the process of grasping container 1. Robot gripping mechanism 8 then lifts and positions container 1 over a hopper (not shown) that is located over a mixing or reactor vessel (not shown). Robot gripping mechanism 8 inverts container 1 so that its contents are dispensed into the mixing or reaction vessel. In a preferred embodiment, robot gripping mechanism 8 rotates container 1 by 180° to dispense the contents.

After the initial dumping of the container contents, inflater mechanism 10 having a pliable vacuum cup 11 is positioned over hole(s) 9 in the bottom of container 1. Pliable vacuum cup 11 may be made of rubber or other similar material. Preferably, robot gripping mechanism 8 raises container 1 toward inflater mechanism 10, since the robot gripping mechanism typically has finer movement control than inflater mechanism 10. Pliable vacuum cup 11 is pressed against the bottom of container 1, completely covering hole(s) 9 and creating a gas/vacuum-tight seal.

Figure 4:
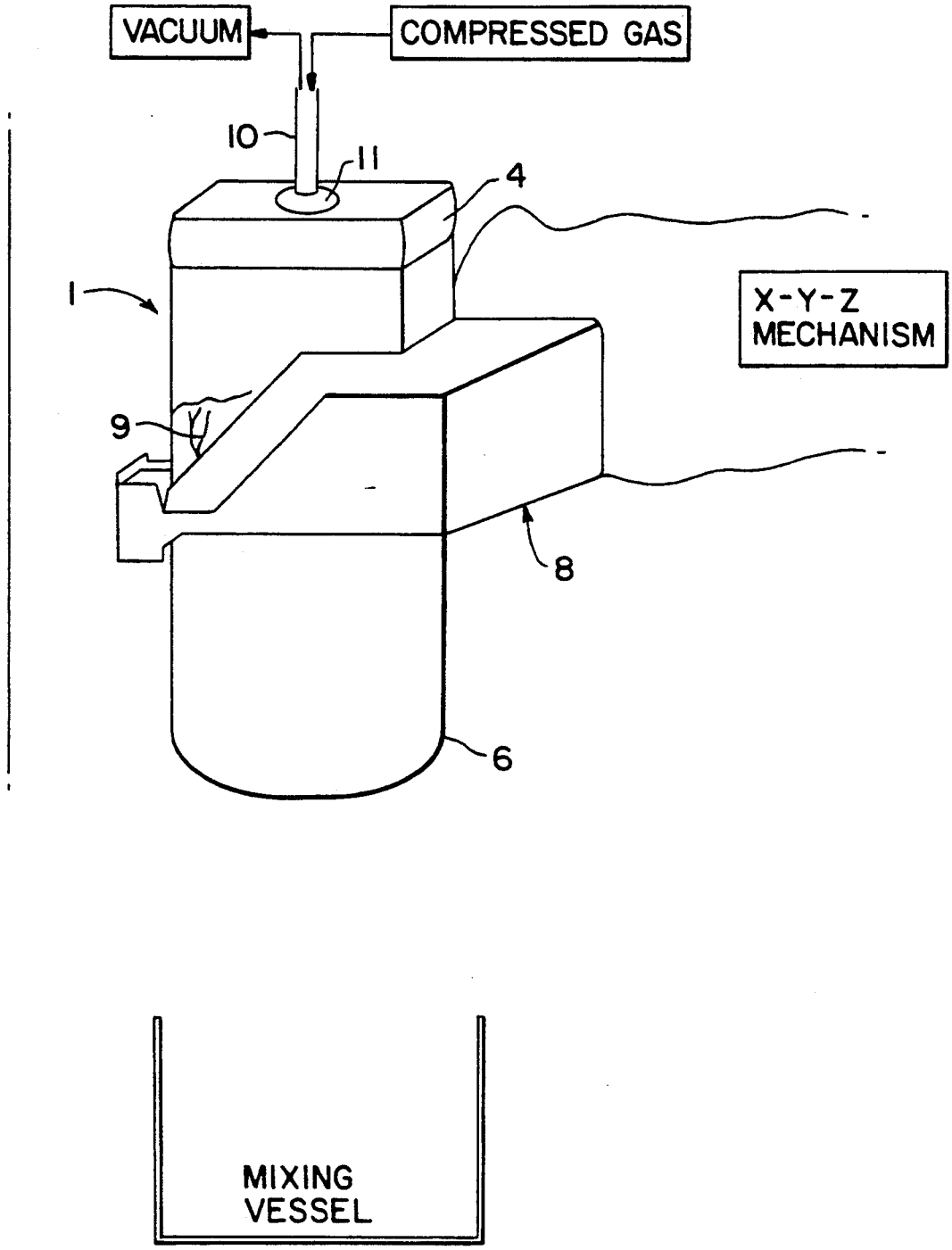
FIG. 4 is a perspective view of the container gripped by the robot gripping mechanism and rotated 180° in order to dispense the contents of the container.

Pliable vacuum cup 11 is connected to a pump (not shown). Since liner 6 is securely sealed against the sides of container 1, introduction of low pressure, high volume gas by the pump into the space between liner 6 and container 1 forces liner 6 to evert, that is, to turn inside out, as shown in FIG. 4. The gas may be any inert gas. Air may be used, but it may be preferable in a clean room situation to use a containerized gas, for example, $N_2$.

Gas pressure is maintained until liner 6 is fully everted. When a 2.5 mil thick polyethylene liner is used, a pump pressure of approximately 50 inches $H_2O$ is necessary to evert liner 6. The pressure will vary, depending on the thickness of liner 6 and the tightness of the seal between liner 6 and container 1. In this way, the entire contents of a rigid container containing a known quantity of a solid material can be dispensed into a mixing or reactor vessel.

Alternatively, devices other than pliable vacuum cup 11 can be used to effect the gas/vacuum-tight seal of inflater mechanism 10 with container 1. These include a fixture on the bottom of container 1 that sealingly engages a fixture on inflater mechanism 10. These other devices are less preferred, however, since they introduce an unnecessary level of complexity into both container 1 and the mating of container 1 and inflater mechanism 10.

Once the contents of container 1 have been dispensed, vacuum is applied to draw liner 6 back into container This prevents liner 6 from becoming entangled in or soiling the equipment. When a 2.5 mil thick polyethylene liner is used, a pump pressure of approximately 50 inches $H_2O$ is necessary to pull in liner 6. Here again the pressure will vary depending on the thickness of liner 6 and the tightness of the seal between liner 6 and container After liner 6 is repositioned inside container 1, the vacuum is released and inflater mechanism 10 is withdrawn from container 1. Robot gripping mechanism then rotates container 1 by 180° to return container 1 to its upright position and replace it on the automated handling system.

After use, container 1 can be refilled with a precise amount of solid material. If container 1 is to be refilled with a different material, liner 6 is removed from container and a new liner is inserted.

While the invention has been described in detail with respect to particular preferred embodiments, it should be understood that such description is presented by way of illustration and not limitation. Many changes and modifications within the scope of the present invention may be made without departing from the spirit thereof, and the invention includes all such modifications.

What is claimed is:

1. A materials handling system, comprising:

a rigid container having on open upper end and at least one perforate region which allows the passage of a gas;

a flexible liner for containing a gelatinous material in the container, an upper portion of the flexible liner being adapted for sealing against a side of the container to create a closed space between the container and the liner into which a gas can be injected through the perforate region;

means for grasping and inverting the container; and means for injecting a gas through the perforate region into the space between the flexible liner and the container to evert the flexible liner and to dispense the gelatinous material.

2. A materials handling system as claimed in claim 1, wherein the perforate region is in a bottom of the container.

3. A materials handling system as claimed in claim 1, wherein the flexible liner has a neck portion which extends outwardly of the upper end of the container which is adapted to be folded back around the upper end of the container to form a cuff.

4. A materials handling system as claimed in claim 1, wherein the grasping and inverting means seals the flexible liner against the side of the container.

5. A materials handling system as claimed in claim additionally comprising means to withdraw the gas from the space between the flexible liner and the container to draw the everted liner into the container.

6. A materials handling system as claimed in claim 1, wherein the grasping and inverting means is a robot gripping mechanism.

7. A materials handling system as claimed in claim 5, additionally comprising means for moving the robot gripping mechanism in the x-direction, means for moving the robot gripping mechanism in the z-direction and means for rotating the robot gripping mechanism about its center axis.

8. A materials handling system as claimed in claim 1, wherein the means for injecting a gas through the perforate region comprises a pliable vacuum cup.

9. A materials handling system as claimed in claim wherein the container comprises interactive means which cooperate with the grasping and inverting means.

10. A materials handling system as claimed in claim 9, wherein the interactive means comprises a lip on an outer surface of the container.

11. A materials handling system as claimed in claim 10, wherein the lip is continuous.

12. A materials handling system as claimed in claim 1, wherein a bottom of the container comprises means specially adapted for cooperating with an automated handling system.

13. A materials handling system as claimed in claim 1, wherein the means for injecting gas comprises means for introducing low pressure, high volume gas into a space between the flexible liner and the container.

14. A method for precisely dispensing the gelatinous contents of a container, comprising the steps of:

providing a rigid container having an open upper end and at least one perforate region which allows the passage of a gas, the container having a flexible liner containing a gelatinous material, said flexible liner being adapted to be sealed against a side of the container;

sealing the liner against a side of the container to create a closed space between the container and the liner into which a gas can be injected through the perforate region;

grasping and inverting the container; and injecting a gas through the perforate region in the container into the space between the flexible liner and the container to evert the flexible liner and dispense the gelatinous material.

15. A method for precisely dispensing the contents of a container as claimed in claim 14, wherein the container has a bottom and the perforate region is in the bottom of the container.

16. A method for precisely dispensing the contents of a container as claimed in claim 14, wherein the flexible liner has a neck portion extending outwardly of the upper end of the container and adapted to be folded back around the upper end of the container to form a cuff.

17. A method for precisely dispensing the contents of a container as claimed in claim 14, additionally comprising the step of withdrawing the gas through the perforate region to draw the everted liner back into the container.

18. A method for precisely dispensing the contents of a container as claimed in claim 14, additionally comprising the step of transporting the container to and from a dumping station where the contents are dispensed during the inverting step.

19. A method for precisely dispensing the contents of a container as claimed in claim 14, wherein the step of grasping the container seals the liner against the sides of the container.

20. A method for precisely dispensing the contents of a container as claimed in claim 14, wherein the grasping and inverting step comprises grasping the container, lifting the container, moving the container over a mixing or reactor vessel, and inverting the container to dispense the contents of the container into the mixing or reactor vessel.

21. A method for precisely dispensing the contents of a container as claimed in claim 14, wherein the inverting step comprises rotating the container 180°.

22. A method for precisely dispensing the contents of a container as claimed in claim 14, wherein the step of injecting gas comprises introducing of low pressure, high volume gas into a space between the flexible liner and the container.

* * * * *